US008472645B2

(12) United States Patent
Wang

(10) Patent No.: US 8,472,645 B2
(45) Date of Patent: Jun. 25, 2013

(54) DEVICE WITH DYNAMIC MAGNET LOUDSPEAKER

(76) Inventor: Chao-Lang Wang, Xizhi (TW)

( * ) Notice: Subject to any disclaimer, the term of this patent is extended or adjusted under 35 U.S.C. 154(b) by 454 days.

(21) Appl. No.: 12/801,986

(22) Filed: Jul. 7, 2010

(65) Prior Publication Data

US 2011/0243369 A1 Oct. 6, 2011

(30) Foreign Application Priority Data

Apr. 6, 2010 (TW) ..... 99110529 A

(51) Int. Cl.
*H04R 1/00* (2006.01)

(52) U.S. Cl.
USPC ..... 381/152; 381/386; 381/191

(58) Field of Classification Search
USPC ..... 381/152, 386, 191
See application file for complete search history.

(56) References Cited

U.S. PATENT DOCUMENTS

| | | | | |
|---|---|---|---|---|
| 6,934,399 | B2 * | 8/2005 | Kam | 381/152 |
| 7,010,143 | B2 * | 3/2006 | Kam | 381/426 |
| 7,174,025 | B2 * | 2/2007 | Azima et al. | 381/152 |
| 7,194,098 | B2 * | 3/2007 | Azima et al. | 381/152 |
| 7,283,636 | B2 * | 10/2007 | Nishimura et al. | 381/152 |
| 7,283,637 | B2 * | 10/2007 | Suzuki et al. | 381/152 |
| 7,302,068 | B2 * | 11/2007 | Longbottom et al. | 381/162 |
| 7,657,043 | B2 * | 2/2010 | Wada et al. | 381/152 |
| 7,664,278 | B2 * | 2/2010 | Watanabe et al. | 381/152 |
| 7,680,293 | B2 * | 3/2010 | Lin et al. | 381/349 |
| 7,844,068 | B1 * | 11/2010 | Carver | 381/354 |
| 7,974,433 | B2 * | 7/2011 | Andersen et al. | 381/398 |
| 8,180,074 | B2 * | 5/2012 | Ko et al. | 381/152 |
| 2001/0012369 | A1 * | 8/2001 | Marquiss | 381/86 |
| 2001/0055402 | A1 * | 12/2001 | Azima | 381/152 |
| 2002/0027999 | A1 * | 3/2002 | Azima et al. | 381/431 |
| 2002/0034314 | A1 * | 3/2002 | Colloms et al. | 381/353 |
| 2002/0094095 | A1 * | 7/2002 | Ellis et al. | 381/152 |
| 2002/0118847 | A1 * | 8/2002 | Kam | 381/111 |
| 2002/0191807 | A1 * | 12/2002 | Asada et al. | 381/335 |
| 2003/0053643 | A1 * | 3/2003 | Bank et al. | 381/152 |
| 2003/0059068 | A1 * | 3/2003 | Bank et al. | 381/152 |
| 2003/0059069 | A1 * | 3/2003 | Bank et al. | 381/152 |
| 2003/0059079 | A1 * | 3/2003 | Asahina et al. | 381/396 |
| 2004/0037447 | A1 * | 2/2004 | Kam | 381/431 |
| 2004/0156527 | A1 * | 8/2004 | Stiles et al. | 381/412 |
| 2004/0234087 | A1 * | 11/2004 | Kam | 381/152 |
| 2005/0002537 | A1 * | 1/2005 | Azima et al. | 381/152 |
| 2005/0141744 | A1 * | 6/2005 | Hlibowicki | 381/396 |
| 2005/0147274 | A1 * | 7/2005 | Azima et al. | 381/431 |
| 2005/0226445 | A1 * | 10/2005 | Murray | 381/152 |
| 2005/0276427 | A1 * | 12/2005 | Kam | 381/152 |
| 2005/0286729 | A1 * | 12/2005 | Harwood et al. | 381/152 |

(Continued)

*Primary Examiner* — David S. Warren
(74) *Attorney, Agent, or Firm* — Bacon & Thomas, PLLC

(57) ABSTRACT

The present invention is to provide a device with dynamic magnet speaker, which comprises a first housing member having a wall and a first magnetic element fixed on an inner surface of the wall; a seat having a first side connected to the first housing member to define a first receiving space between the first housing member and the first side of the seat; and a hollow tube fixedly provided on the seat and corresponding in position to the first magnetic element, wherein a first coil unit is fixedly mounted around the hollow tube, and the hollow tube extends toward the first magnetic element and is either mounted around an outer periphery of the first magnetic element or inserted in a first central hole of the first magnetic element, so as to not only reduce the weight and spatial volume thereof, but also substantially lower the directivity of sound produced.

26 Claims, 12 Drawing Sheets

U.S. PATENT DOCUMENTS

2006/0093165 A1* 5/2006 Kamimura et al. ..... 381/152
2006/0159293 A1* 7/2006 Azima et al. ..... 381/152
2009/0034759 A1* 2/2009 Ko et al. ..... 381/152
2011/0243369 A1* 10/2011 Wang ..... 381/400
2012/0082317 A1* 4/2012 Pance et al. ..... 381/59
2012/0250928 A1* 10/2012 Pance et al. ..... 381/386
2012/0294474 A1* 11/2012 Wu ..... 381/400

* cited by examiner

DEVICE WITH DYNAMIC MAGNET LOUDSPEAKER

FIELD OF THE INVENTION

The present invention relates to a device with loudspeaker, more particularly to a device with dynamic magnet speaker, which comprises a first housing member having a wall and a first magnetic element fixed on an inner surface of the wall; a seat having a first side connected to the first housing member to define a first receiving space between the first housing member and the first side of the seat; and a hollow tube fixed on the seat and corresponding in position to the first magnetic element, wherein a first coil unit is fixed around the hollow tube, and the hollow tube extends toward the first magnetic element and is either mounted around an outer periphery of the first magnetic element or inserted in a first central hole of the first magnetic element. Thus, when a current flows through and thereby magnetizes the coil unit, the magnetic lines generated by the coil unit and the magnetic lines generated by the magnetic element cause attraction or repulsion that drives the magnetic element to vibrate reciprocally. Consequently, the wall of the housing member vibrates synchronously with the magnetic element to make sound, without need to install a diaphragm, a loudspeaker frame, a damping membrane, or other components. Hence, the device of the present invention not only reduces the weight and spatial volume thereof, but also substantially lowers the directivity of sound produced. Therefore, the sound generated by the device can be heard with equal clarity by users in front of and beside the wall.

BACKGROUND OF THE INVENTION

With the rapid development of information technology and the electronic industry, a plethora of handheld electronic devices (e.g., laptop computers, cell phones, personal digital assistants (PDAs), portable audio players, voice navigation devices, handheld game consoles, etc.) are now available at more and more affordable prices and with ever smaller dimensions. These handheld electronic devices can be easily carried around to provide their users with all kinds of handy functions and bring about tremendous convenience in daily life.

As handheld electronic devices nowadays are increasingly thinner, the space therein for installing loudspeakers decreases. In response, related manufacturers have spared no effort in reducing the spatial volume of loudspeakers, with a view to providing a compact loudspeaker that can fit in the tiny space inside a handheld electronic device. Take a cell phone with a small built-in loudspeaker for example. Referring to FIG. 1, a cell phone 1 includes a housing 11 and a loudspeaker 12. The housing 11 is provided therein with a receiving space 110 and has a lateral surface formed with a loudspeaker fixing hole 111. The loudspeaker 12 includes a frame 121 whose outer rim (i.e., the rim adjacent to a conical diaphragm 122) is fixed to the loudspeaker fixing hole 111, thereby securing the loudspeaker 12 to the housing 11. As a result, the frame 121 and a damping membrane 123 therein, as well as a coil 124 and a magnetic element 125, are received in the receiving space 110. The housing 11 has another lateral surface installed with a display screen 13 and a plurality of pushbuttons 14. The loudspeaker 12, the display screen 13, and the pushbuttons 14 are respectively and electrically connected to a circuit board 15 fixedly provided in the receiving space 110. When a user presses the pushbuttons 14 and thereby instructs the circuit board 15 to drive the loudspeaker

12 for sound reproduction, the circuit board 15 transmits an audio signal current to the coil 124 of the loudspeaker 12. Consequently, the coil 124 is magnetized to produce an electromagnetic effect, and an attractive or repulsive force is created by magnetic lines generated from the coil 124 and magnetic lines generated from the magnetic element 125 fixed to the periphery of the coil 124. As the audio signal current input to the coil 124 varies in magnitude and direction, the conical diaphragm 122 is driven to vibrate reciprocally, causing the loudspeaker 12 to make sound that propagates outward from the housing 11.

The frame 121, the conical diaphragm 122, the damping membrane 123, the coil 124, and the magnetic element 125 are indispensable components when making the loudspeaker 12 with existing techniques. However, such components, particularly the frame 121, the conical diaphragm 122, and the damping membrane 123, take up a huge amount of space and make it impossible to downsize the loudspeaker 12 effectively. On the other hand, the frame 121 is made of metal and therefore weighs considerably. Once the loudspeaker 12 equipped with the frame 121 is installed in the cell phone 1, the overall weight of the cell phone 1 is increased, which may reduce consumers' willingness to purchase the cell phone 1 and carry it with them. In consequence, the competitiveness of the assemblers and manufacturers of the cell phone 1 is impaired, which is undesirable not only to the assemblers and manufacturers, but also to users in general.

Moreover, as the loudspeaker 12 in the cell phone 1 must have small dimensions, the sound generated by the loudspeaker 12 has a low acoustic volume and high directivity. In other words, the highest volume and the sound of angle of the loudspeaker 12 are limited. As a result, the user may have problem hearing a loud and clear sound from the cell phone 1. Even worse, the user may have to be right in front of the handheld electronic device to hear only a vague sound, and nothing can be heard if the user is beside the handheld electronic device.

Therefore, the problem to be addressed by the present invention is to break through the bottleneck of existing loudspeaker manufacturing technology and design a novel loudspeaker capable of substantially reducing the spatial volume and overall weight of a device equipped with the loudspeaker; producing the optimal sound effects in terms of tone quality, acoustic volume, and directivity; and allowing users in front of and beside the device to hear clearly the sound generated thereby.

BRIEF SUMMARY OF THE INVENTION

In view of the aforesaid shortcomings of the prior art, the inventor of the present invention put years of practical experience into research and experiment and finally succeeded in developing a device with a dynamic magnet loudspeaker and thus overcoming the bottleneck of existing loudspeaker manufacturing technology. The device with the dynamic magnet loudspeaker disclosed herein not only has a significantly reduced spatial volume and overall weight, but also can generate a loud and clear sound with low directivity.

It is an object of the present invention to provide a device with a dynamic magnet loudspeaker. The device includes at least one housing member, a seat, a magnetic element, and a hollow tube. The housing member is connected with the seat to form a single unit and thereby define a receiving space between the housing member and the seat. The magnetic element is a permanent magnet and is fixedly provided on the inner surface of a wall of the housing member either directly or indirectly (e.g., via a spacer). The hollow tube has a first end fixedly mounted with a coil unit and a second end fixedly provided on the seat at a position corresponding to the magnetic element. The coil unit is formed by at least one metal wire wound around the first end of the hollow tube in a predetermined manner. The first end of the hollow tube extends toward the magnetic element and is mounted around the outer periphery of the magnetic element (or inserted in a central hole of the magnetic element). When a current flows through and thereby magnetizes the coil unit, the coil unit generates magnetic lines. The magnetic lines generated by the coil unit and the magnetic lines generated by the magnetic element cause attraction or repulsion that drives the magnetic element to vibrate reciprocally. Consequently, the wall of the housing member vibrates synchronously with the magnetic element, and the air on both sides of the wall is vibrated to make sound. As the magnetic element is installed directly on the wall, and the hollow tube is fixedly provided in the seat, the wall is directly vibrated to generate sound (with the magnetic element being movable, and the coil unit fixed in place), without need to install a diaphragm, a loudspeaker frame, a damping membrane, or other components. Hence, the spatial volume of the housing member and of the seat is substantially reduced while the overall weight of the device is lowered, allowing the device with the dynamic magnet loudspeaker of the present invention to be applied to various kinds of handheld electronic devices (e.g., laptop computers, cell phones, PDAs, portable audio players, etc.). The device of the present invention not only helps to reduce the weight and spatial volume of a variety of handheld electronic devices, but also substantially lower the directivity of sound produced. This is because when air outside the wall is vibrated to make sound, there is no directional limitation otherwise imposed by the conventional conical diaphragm. Therefore, the sound generated by the device can be heard with equal clarity by users in front of and beside the wall. The housing member may have a square, rectangular, circular, elliptical, or other shapes, and may have different angles. The inner surface of the housing member may be provided with a plurality of heat-dissipating plates having a thin configuration, a grid-like configuration, or other configurations. The inner and outer surfaces of the housing member may also be flat, convex, concave, or corrugated. The dimensions of the device may vary with its configuration. For instance, the device can be as small as a mini earplug.

In the device with the dynamic magnet loudspeaker of the present invention, the housing member itself can transmit sound outward, so there is no need to drill holes in the peripheral surfaces of the housing member. By contrast, commercially available laptop computers, cell phones, PDAs, portable audio players, etc. must be provided with holes to enable sound propagation from loudspeakers, and the holes are disadvantageous to moisture-proof and overall tightness of these products. However, when the device of the present invention is used in the foregoing products, moisture-proof and overall tightness of the products can be substantially increased, for the peripheral surfaces of the housing member need not be drilled.

BRIEF DESCRIPTION OF THE SEVERAL VIEWS OF THE DRAWINGS

A detailed description of further features and advantages of the present invention is given below with reference to the accompanying drawings, in which.

DETAILED DESCRIPTION OF THE INVENTION

Figure 1:
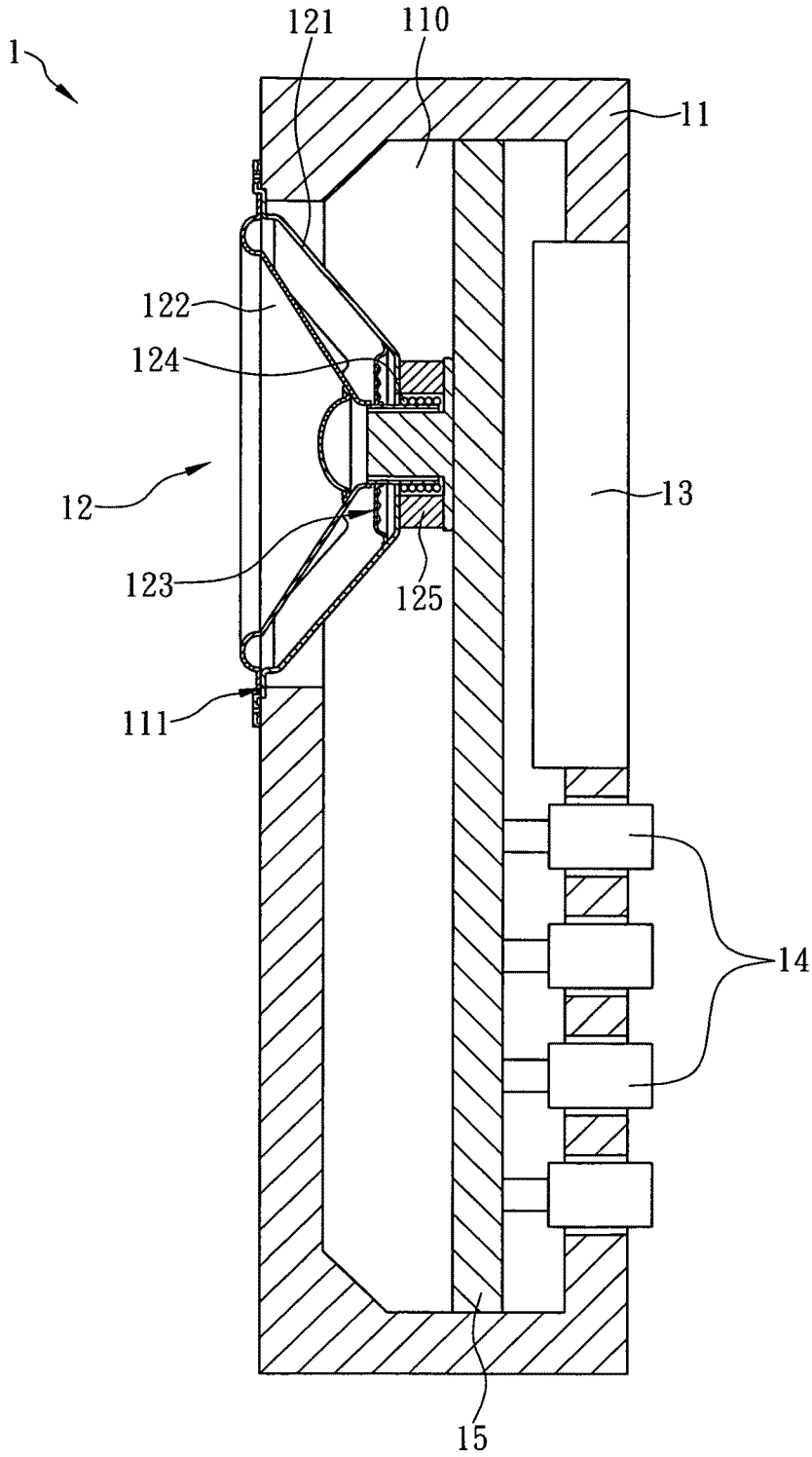
FIG. 1 (Prior Art)
FIG. 1 is a sectional view of a cell phone with a small built-in loudspeaker.
Figure 2:
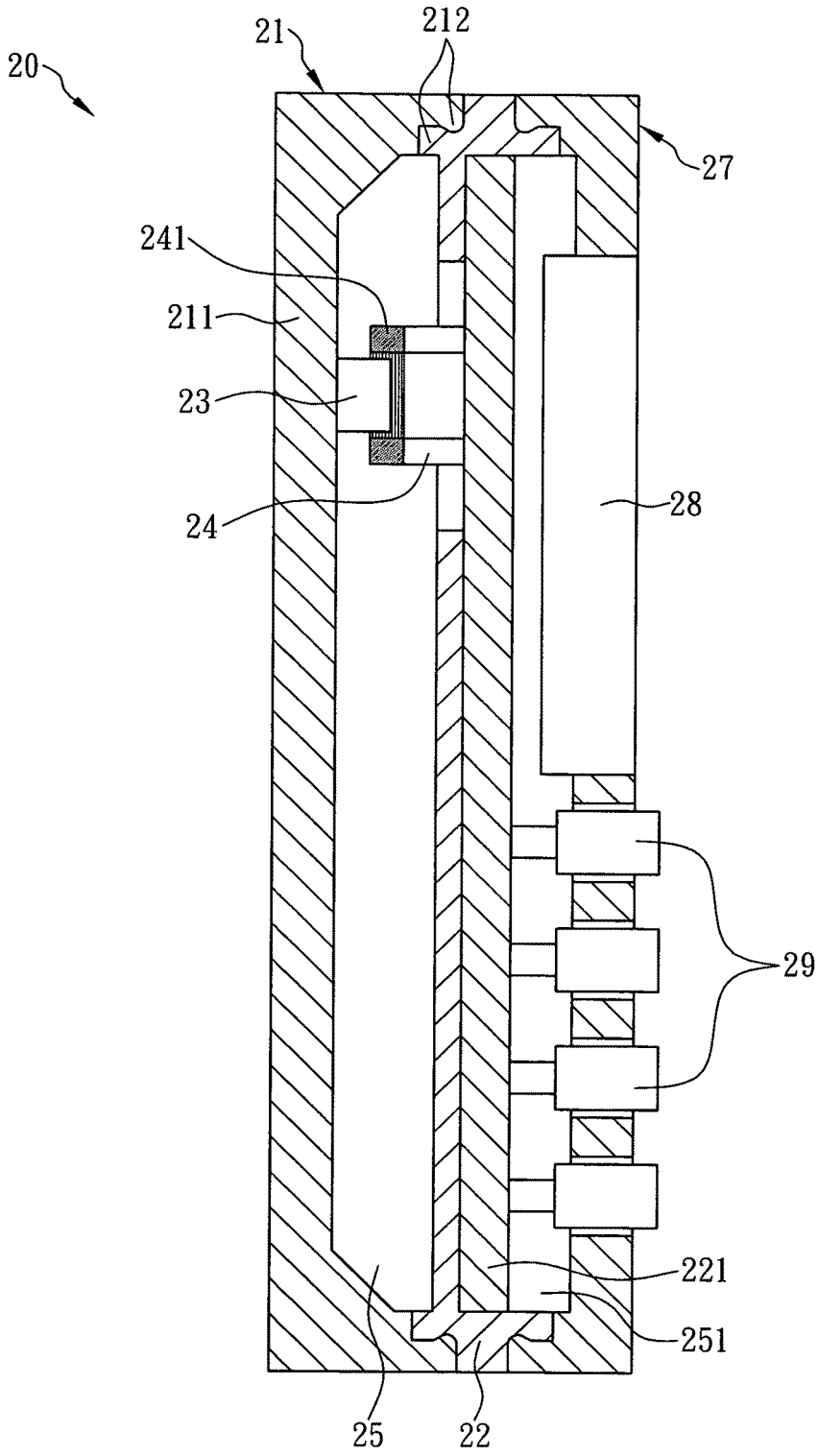
FIG. 2 is a sectional view of a first preferred embodiment of the present invention.

The present invention is directed to a device with a dynamic magnet loudspeaker. Referring to FIG. 2, a device 20 according to a first preferred embodiment of the present invention is a handheld electronic device (e.g., a laptop computer, a cell phone, a PDA, a portable audio player, a voice navigation device, a handheld game console, etc.). The device 20 includes a first housing member 21, a seat 22, a first magnetic element 23, a hollow tube 24, and a second housing member 27. In the present embodiment, the first housing member 21 has a square U-shaped cross-section. Moreover, the first housing member 21 has two ends each provided with a fastening element 212, and the seat 22 also has two ends each provided with a fastening element 212, wherein the fastening elements 212 of the first housing member 21 correspond in position to and can be fastened with the fastening elements 212 of the seat 22. When the corresponding fastening elements 212 of the first housing member 21 and of the seat 22 are fastened together, the first housing member 21 is connected to a first side of the seat 22 to form a single unit, thereby defining a first receiving space 25 between the first housing member 21 and the first side of the seat 22. However, the cross-sectional configuration of the first housing member 21 is not limited to the foregoing; the first housing member 21 may have any other cross-sectional shapes, provided that the first housing member 21 can be connected to the first side of the seat 22 to form a single unit and thereby define the first receiving space 25 between the first housing member 21 and the first side of the seat 22. In addition, a circuit board 221 is embedded in the seat 22 of the present embodiment.

The first magnetic element 23 is a permanent magnet and is fixedly provided on the inner surface of a wall 211 of the first housing member 21. The hollow tube 24 is fixedly provided on the circuit board 221 in the seat 22 and corresponds in position to the first magnetic element 23. A first coil unit 241 is fixedly mounted around a first end of the hollow tube 24 while a second end of the hollow tube 24 is connected to the circuit board 221 in the seat 22 (i.e., to a surface of the first side of the seat 22). The first coil unit 241 is formed by at least one metal wire wound around the first end of the hollow tube 24 in a predetermined manner. The first end of the hollow tube 24 extends toward the first magnetic element 23 and is mounted around the outer periphery thereof. The second housing member 27 is connected to a second side of the seat 22 to form a single unit and thereby define a second receiving space 251 between the second housing member 27 and the second side of the seat 22. Furthermore, a display screen 28 and a plurality of pushbuttons 29 are embedded in the outer surface of the second housing member 27. The first coil unit 241, the display screen 28, and the pushbuttons 29 are respectively and electrically connected to the circuit board 221. When a user presses the pushbuttons 29 and thus instructs the circuit board 221 to drive the first coil unit 241, the circuit board 221 transmits an audio signal current to the first coil unit 241 and thus magnetizes the first coil unit 241. Magnetic lines generated by the first coil unit 241 and magnetic lines generated by the first magnetic element 23 cause attraction or repulsion that drives the first magnetic element 23 to vibrate reciprocally. In consequence, the wall 211 of the first housing member 21 vibrates synchronously with the first magnetic element 23 and thereby vibrates the air on both sides of the wall 211 to make sound.

In the present invention, as the first magnetic element 23 is installed directly on the wall 211 of the first housing member 21, and the hollow tube 24 is fixed on the circuit board 221 in the seat 22, the wall 211 of the first housing member 21 is directly vibrated to make sound. Therefore, components commonly found in a conventional loudspeaker structure such as the diaphragm, loudspeaker frame, and damping membrane can be dispensed with to substantially reduce the volume of the first housing member 21 and the seat 22, as well as the overall weight of the device 20, thus allowing the device 20 with the dynamic magnet loudspeaker of the present invention to be applied to a variety of handheld electronic devices such as laptop computers, cell phones, PDAs, portable audio players, etc. The present invention also contributes to increasing consumers' willingness to buy such handheld electronic devices and carry these devices with them, and strengthening the competitiveness of the assemblers and manufacturers of the aforesaid handheld electronic devices. Besides, without the conventional conical diaphragm and hence the directional limitation otherwise imposed thereby on the sound made by vibration of air outside the wall 211 of the first housing member 21, the directivity of sound generated by the device 20 is significantly lowered, thus allowing the sound generated by the device 20 to be heard with equal clarity by users in front of and beside the wall 211 of the first housing member 21.

Figure 3:
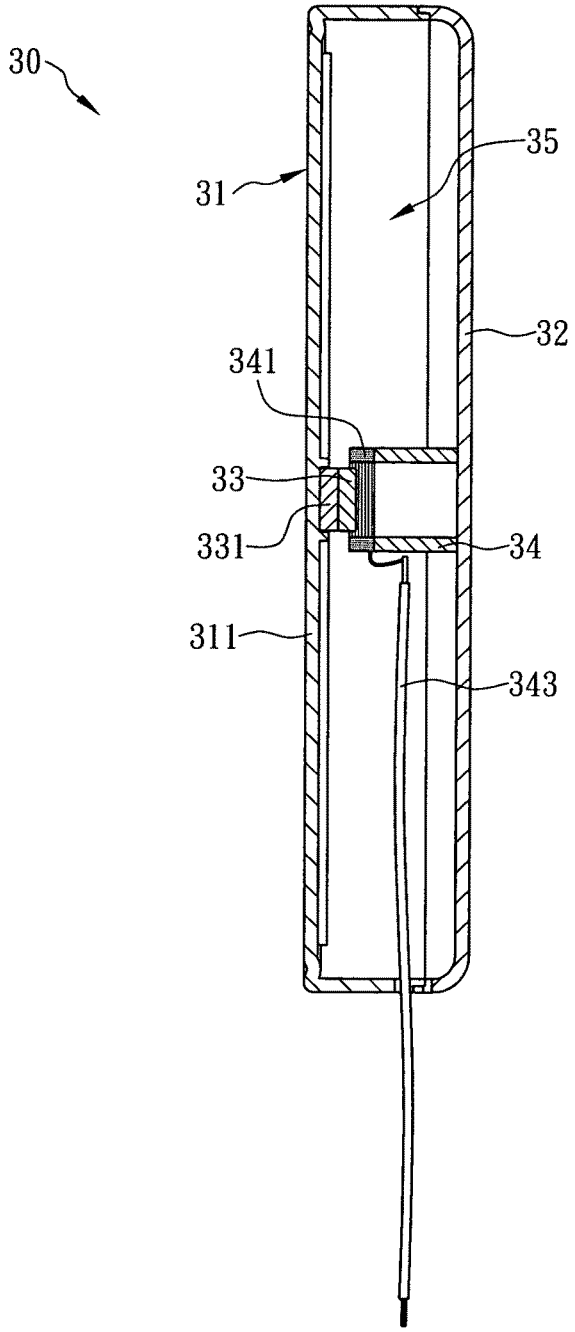
FIG. 3 is a sectional view of a second preferred embodiment of the present invention.

Please refer to FIG. 3 for a second preferred embodiment of the present invention, wherein the device 30 shown is a loudspeaker device to be placed on the floor, suspended from the ceiling, etc. The dimensions of the device 30 may vary with its configuration. For instance, the device 30 can be as small as a mini earplug. The device 30 includes a first housing member 31, a seat 32, a first magnetic element 33, and a hollow tube 34. The first housing member 31 is connected to a side of the seat 32 to form a single unit and thereby define a first receiving space 35 between the first housing member 31 and the side of the seat 32. The first magnetic element 33 is a permanent magnet and is fixedly provided on the inner surface of a wall 311 of the first housing member 31 via a first spacer 331. The hollow tube 34 is fixedly provided on the seat 32 and corresponds in position to the first magnetic element 33. A first coil unit 341 is fixedly mounted around a first end of the hollow tube 34 while a second end of the hollow tube 34 is connected to a surface of the side of the seat 32. The first coil unit 341 is formed by at least one metal wire wound around the first end of the hollow tube 34 in a predetermined way. The first coil unit 341 is electrically connected to a wire 343 so as to receive an external audio signal current through the wire 343. The first end of the hollow tube 34 extends toward the first magnetic element 33 and is mounted around the outer periphery thereof. When a current fed from the wire 343 passes through and thus magnetizes the first coil unit 341, magnetic lines generated by the first coil unit 341 and magnetic lines generated by the first magnetic element 33 cause attraction or repulsion that drives the first magnetic element 33 into reciprocal vibration. As a result, the wall 311 of the first housing member 31 vibrates synchronously along with the first magnetic element 33 and thereby vibrates the air on both sides of the wall 311 to make sound.

Figure 4:
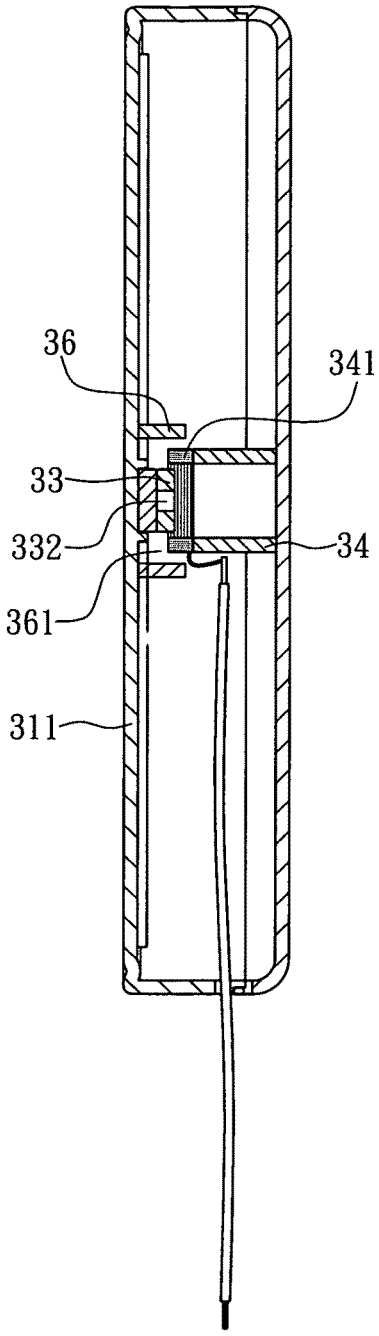
FIG. 4 is a sectional view of another aspect of the second preferred embodiment of the present invention.

Referring to FIG. 4 for another aspect of the second preferred embodiment of the present embodiment, the first magnetic element 33 is further provided with a first central hole 332 for reducing the weight of the first magnetic element 33. Therefore, when driven to vibrate reciprocally by the attractive or repulsive force created by the magnetic lines of the first coil unit 341 and the magnetic lines of the first magnetic element 33, the first magnetic element 33, whose weight is reduced due to the first central hole 332, responds more sensitively and more rapidly to the attractive or repulsive force. In consequence, the wall 311 of the first housing member 31 vibrates with the first magnetic element 33 in a more sensitive and more rapid manner, and a pure and clear sound is produced when the air on both sides of the wall 311 of the first housing member 31 is vibrated. In addition, an annular magnetic element 36 is mounted around and located outside the first magnetic element 33. The annular magnetic element 36 is provided with an annular central hole 361 for receiving the first magnetic element 33 such that a predetermined spacing is formed between the outer periphery of the first magnetic element 33 and the inner periphery of the annular magnetic element 36. Therefore, while the first end of the hollow tube 34 extends toward the first magnetic element 33 and is mounted around the outer periphery thereof, the outer periphery of the first end of the hollow tube 34 is located within the annular central hole 361 of the annular magnetic element 36. When the first coil unit 341 at the first end of the hollow tube 34 is magnetized by a current to generate magnetic lines, the magnetic lines of the first coil unit 341 interact not only with the magnetic lines generated by the first magnetic element 33, but also with the magnetic lines generated by the annular magnetic element 36, hence creating even stronger attraction or repulsion. The first magnetic element 33 and the annular magnetic element 36, when driven into reciprocal vibration by such enhanced attraction or repulsion, transmit the vibration sufficiently to the wall 311 of the first housing member 31. As a result, the wall 311 of the first housing member 31 vibrates forcefully and synchronously with the first magnetic element 33 and the annular magnetic element 36, and when the air on both sides of the wall 311 of the first housing member 31 is vibrated, a sound with enhanced clarity and increased loudness is generated.

Figure 5:
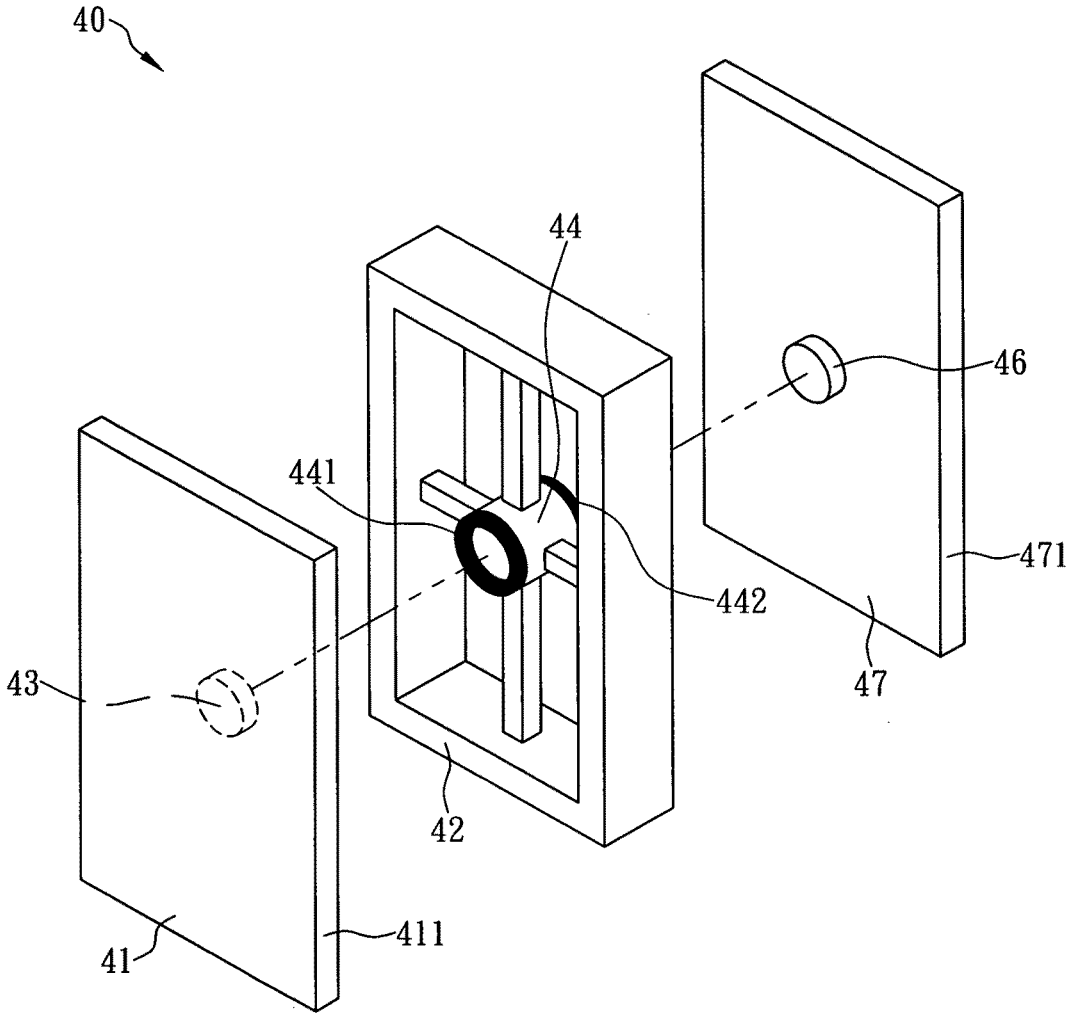
FIG. 5 is an exploded perspective view of a third preferred embodiment of the present invention.

Referring to FIG. 5 for a device 40 according to a third preferred embodiment of the present invention, the device 40 includes a first housing member 41, a seat 42, a first magnetic element 43, and a hollow tube 44. The first housing member 41 is connected to a first side of the seat 42 by bonding, riveting, injection molding, or other applicable methods so as to form a single unit. The first magnetic element 43 is directly fixed on the inner surface of a wall 411 of the first housing member 41. The hollow tube 44 is fixedly provided in the seat 42 at a position corresponding to the first magnetic element 43 and penetrates the seat 42 such that a second end of the hollow tube 44 juts out of a second side of the seat 42. A first coil unit 441 is fixedly mounted around a first end of the hollow tube 44. The first end of the hollow tube 44 extends toward the first magnetic element 43 and is mounted around the outer periphery thereof.

Referring again to FIG. 5, in the present embodiment, the device 40 further includes a second housing member 47 and a second magnetic element 46. The second housing member 47 is connected to the second side of the seat 42 to form a single unit. The second magnetic element 46 is directly fixed on the inner surface of a wall 471 of the second housing member 47 and corresponds in position to the second end of the hollow tube 44. Furthermore, a second coil unit 442 is fixedly mounted around the second end of the hollow tube 44, while the second end of the hollow tube 44 extends toward the second magnetic element 46 and is mounted around the outer periphery thereof. When the first housing member 41, the seat 42, and the second housing member 47 are assembled to form a single unit, and the first and second coil units 441 and 442 are magnetized by a current to generate magnetic lines, the magnetic lines generated by the first and second coil units 441 and 442 interact with magnetic lines generated by the first and second magnetic elements 43 and 46, respectively, to cause attraction or repulsion. The first and second magnetic elements 43 and 46, when driven respectively into reciprocal vibration by the attraction or repulsion, transmit the vibration respectively and sufficiently to the wall 411 of the first housing member 41 and the wall 471 of the second housing member 47, causing the wall 411 of the first housing member 41 and the wall 471 of the second housing member 47 to vibrate respectively and synchronously with the first and second magnetic elements 43 and 46. In consequence, the air on both sides of the wall 411 of the first housing member 41 and on both sides of the wall 471 of the second housing member 47 is vibrated to make sound. Since not only the air outside the wall 411 of the first housing member 41 but also the air outside the wall 471 of the second housing member 47 is vibrated to generate sound, the directivity of sound produced by the device 40 is significantly lowered. In other words, the sound produced by the device 40 can be heard with equal clarity regardless of whether the user is in front of or beside the wall 411 of the first housing member 41 or is in front of or beside the wall 471 of the second housing member 47.

Figure 6:
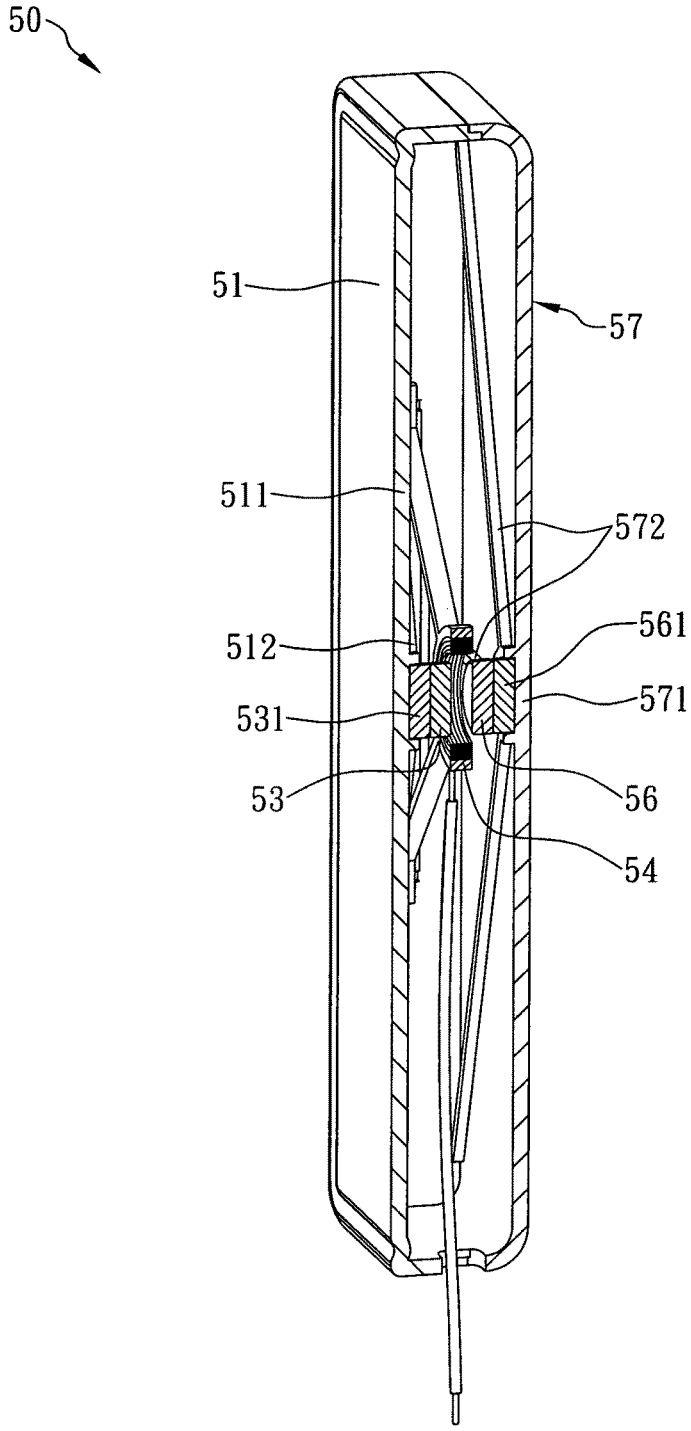
FIG. 6 is a sectional perspective view of a fourth preferred embodiment of the present invention.

In a fourth preferred embodiment of the present invention as shown in FIG. 6, a first magnetic element 53 is fixedly provided on the inner surface of a wall 511 of a first housing member 51 via a first spacer 531, wherein the first housing member 51 is made of plastic, metal, wood, a foamed material, ceramic, or a magnetic material. A plurality of first ribs 512 are provided on the inner surface of the wall 511 of the first housing member 51 and extend radially outward from the vicinity of the first magnetic element 53 and the first spacer 531. The first ribs 512, which serve as auxiliary supporting members, are not limited in thickness and may be omitted in other embodiments of the present invention. The ribs 512 may have a plate-like, grid-like, or other configuration, provided that the ribs 512 can protect and support the first housing member 51. In addition, a second magnetic element 56 is fixedly provided on the inner surface of a wall 571 of a second housing member 57 via a second spacer 561. A plurality of second ribs 572 are provided on the inner surface of the wall 571 of the second housing member 57 and extend radially outward from the vicinity of the second magnetic element 56 and the second spacer 561. When the wall 511 of the first housing member 51 and the wall 571 of the second housing member 57 vibrate respectively and synchronously with the first magnetic element 53 and the second magnetic element 56 to make sound, the wall 511 of the first housing member 51 and the wall 571 of the second housing member 57 are supported respectively by the first ribs 512 and the second ribs 572 and protected from deformation or fracture. Thus, the air on both sides of the wall 511 of the first housing member 51 and on both sides of the wall 571 of the second housing member 57 can be sufficiently vibrated to generate a sound with enhanced clarity and increased loudness. In other embodiments of the present invention, the inner surface of the wall 511 of the first housing member 51 can be equipped with one or more than one first magnetic element 53, and the number and location of the hollow tube 54 in the device 50 may also be modified according to practical needs to correspond to those of the first magnetic element 53.

Figure 7:
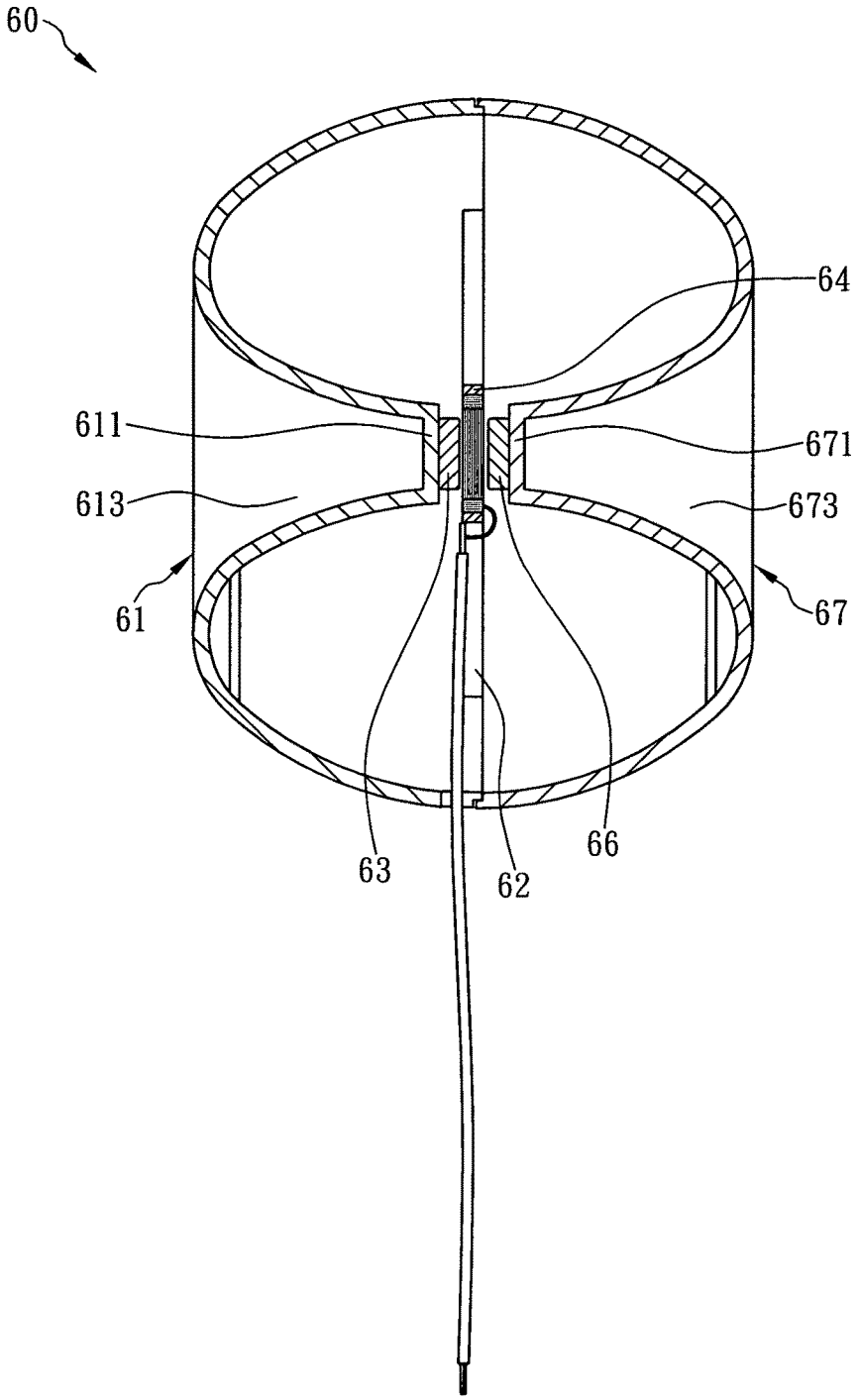
FIG. 7 is a sectional view of a fifth preferred embodiment of the present invention.

Instead of the three-dimensional rectangular configuration shown in FIG. 6, the device 50 may have an elliptical, conical, or other polyhedral configuration. Referring to FIG. 7, a device 60 according to a fifth preferred embodiment of the present invention includes a first housing member 61 and a second housing member 67, each having a curved outer rim. The first and second housing members 61 and 67 are connected to a seat 62 to form a single unit. The first housing member 61 has a wall 611 whose inner surface extends toward a first end of a hollow tube 64. Consequently, a first magnetic element 63 fixedly provided on the inner surface of the wall 611 of the first housing member 61 is positioned at a position corresponding to the first end of the hollow tube 64, and an outer surface of the wall 611 of the first housing member 61 is sunken toward the first end of the hollow tube 64 to form a first conical recess 613. Similarly, the second housing member 67 has a wall 671 whose inner surface extends toward a second end of the hollow tube 64, such that a second magnetic element 66 fixedly provided on the inner surface of the wall 671 of the second housing member 67 is positioned at a position corresponding to the second end of the hollow tube 64, and that an outer surface of the wall 671 of the second housing member 67 is sunken toward the second end of the hollow tube 64 to form a second conical recess 673. When the wall 611 of the first housing member 61 and the wall 671 of the second housing member 67 vibrate respectively and synchronously with the first magnetic element 63 and the second magnetic element 66 to make sound, the sound generated by the wall 611 of the first housing member 61 spreads outward along the first conical recess 613 and is therefore magnified. By the same token, the sound generated by the wall 671 of the second housing member 67 spreads outward along the second conical recess 673 and is magnified as a result.

Figure 8:
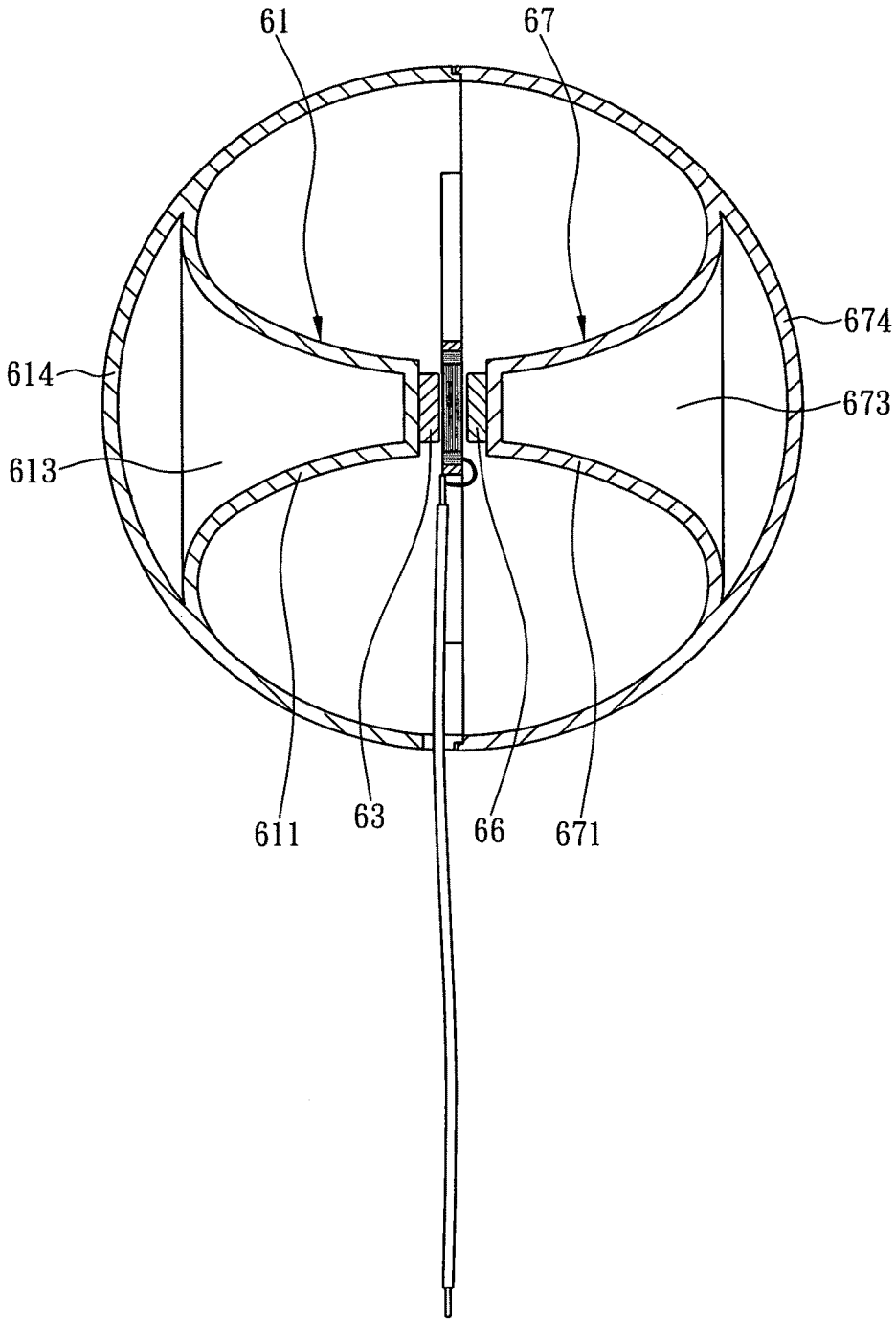
FIG. 8 is a sectional view of another aspect of the fifth preferred embodiment of the present invention.

Referring to FIG. 8 for another aspect of the fifth preferred embodiment of the present invention, the outer surface of the wall 611 of the first housing member 61 has a peripheral portion facing away from the first magnetic element 63 and fixedly provided with a third housing member 614 so as to define a first resonant space between the inner surface of the third housing member 614 and the outer surface of the wall 611 of the first housing member 61. Sound generated by the wall 611 of the first housing member 61 not only spreads outward along the first conical recess 613 but also resonates in the first resonant space, thereby enhancing the tone quality and volume of bass. Likewise, the outer surface of the wall 671 of the second housing member 67 has a peripheral portion facing away from the second magnetic element 66 and fixedly provided with a fourth housing member 674 so as to define a second resonant space between the inner surface of the fourth housing member 674 and the outer surface of the wall 671 of the second housing member 67. Sound generated by the wall 671 of the second housing member 67 not only spreads outward along the second conical recess 673 but also resonates in the second resonant space, thereby enhancing the tone quality and volume of bass. While the third housing member 614 and the fourth housing member 674 in the present embodiment are shown as having curved cross-sections, it is feasible for the third housing member 614 and the fourth housing member 674 to have square, rectangular, elliptical, planar, wavy, or other cross-sectional configurations instead. Furthermore, in the present embodiment, the third housing member 614 and the fourth housing member 674 are respectively and fixedly provided on the outer surface of the wall 611 of the first housing member 61 and the outer surface of the wall 671 of the second housing member 67 by bonding, mechanical engagement, injection molding, or other applicable methods.

Figure 9:
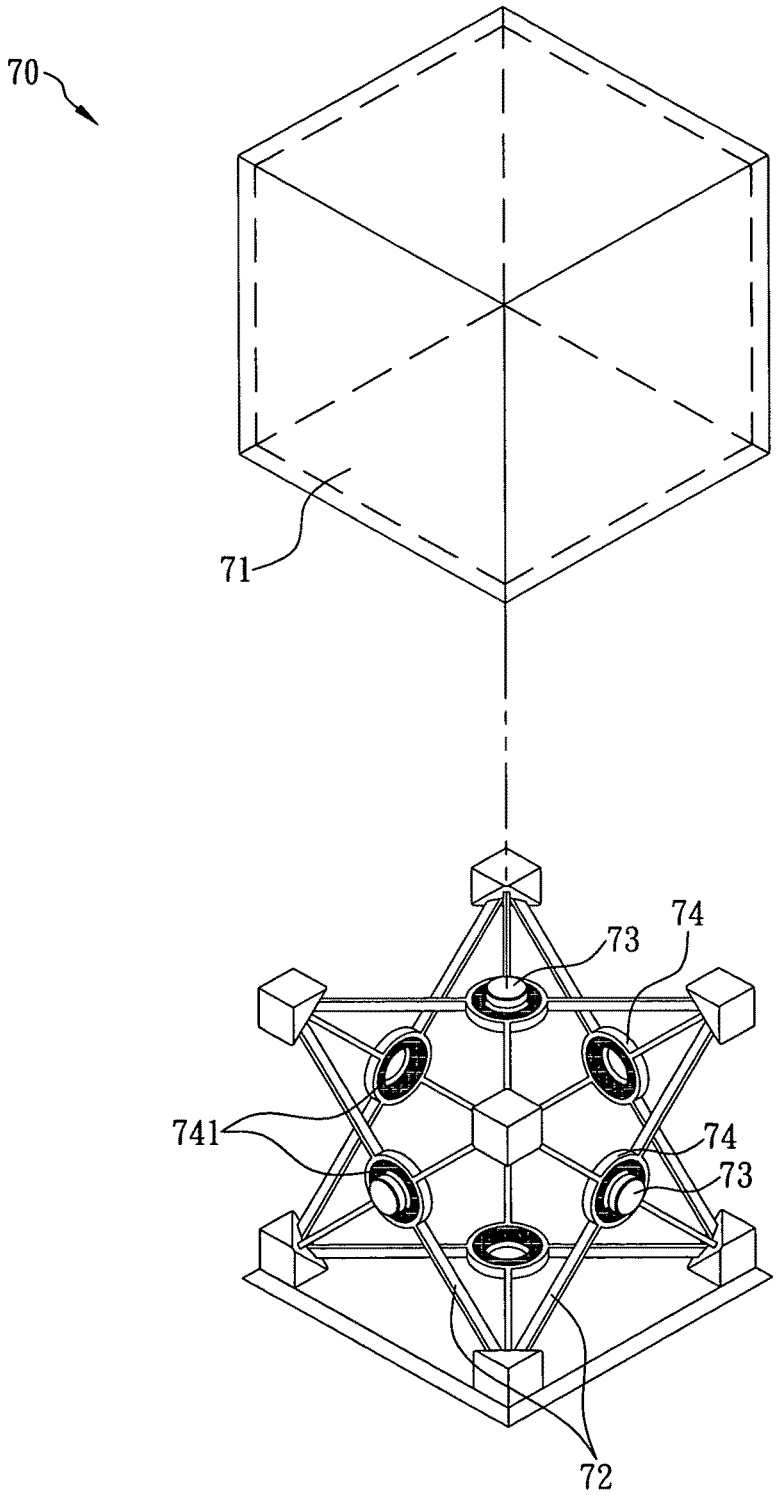
FIG. 9 is a partially exploded perspective view of a sixth preferred embodiment of the present invention.

With reference to FIG. 9, a device 70 according to a sixth preferred embodiment of the present invention includes six first housing members 71 which are made of a magnetic rubber material and assembled together by bonding, mechanical engagement, injection molding, or other applicable methods, such that the device 70 looks like a cube. However, in a different embodiment of the present invention, the device 70 can be assembled from a different number of first housing members 71 so as to form a regular tetrahedron, a regular octahedron, a regular dodecahedron, or other symmetric or asymmetric polyhedrons. The outer configuration of the device 70 is not limited to a cube, and the dimensions of the device 70 may vary with its configuration. For instance, the device 70 can be as small as a mini earplug. Furthermore, each first housing member 71 has a wall (not shown in the drawing but equivalent to the wall 211, 311, 411, 511, or 611 in the first to fifth preferred embodiments of the present invention) whose inner or outer surface can be provided with a plurality of heat-dissipating plates so that the heat generated by a current flowing through the device 70 can be transmitted outside the first housing members 71. The heat-dissipating plates can be made of gold, silver, copper, iron, or PCB and have a thin configuration, a grid-like configuration, or other configurations.

A first magnetic element 73 is directly fixed on the wall (not shown in the drawing but equivalent to the wall 211, 311, 411, 511, or 611 in the first to fifth preferred embodiments of the present invention) of each first housing member 71. Each first housing member 71 is connected to a side of a seat 72 to form a single unit. A hollow tube 74 is fixedly provided in each seat 72 at a position corresponding to the corresponding first magnetic element 73 and penetrates each said seat 72 such that a second end of the hollow tube 74 juts out of the opposite side of each said seat 72. A first coil unit 741 is fixedly mounted around a first end of each hollow tube 74. The first end of each hollow tube 74 extends toward the corresponding first magnetic element 73 and is mounted around the outer periphery thereof. In a different embodiment of the present invention, however, not the wall of every first housing member 71 is provided with a first magnetic element 73. In the device 70, the number of the first magnetic elements 73, the hollow tubes 74, and the first coil units 741 may range from one to six. Besides, the locations of the first magnetic elements 73, the hollow tubes 74, and the first coil units 741 may be modified according to practical needed, and so may the number of the first magnetic elements 73, the first coil units 741, and the hollow tubes 74 on the wall of each first housing member 71, provided that the first magnetic elements 73 are fixed on the walls of the first housing members 71 and that the hollow tubes 74 have their respective first ends extending toward the corresponding first magnetic elements 73 and mounted around the outer peripheries thereof.

When the first housing members 71 are assembled into one unit, and the first coil unit 741 at the first end of each hollow tube 74 is magnetized by a current to generate magnetic lines, the magnetic lines generated by the first coil units 741 and the magnetic lines generated by the first magnetic elements 73 create attraction or repulsion that drives the first magnetic elements 73 into reciprocal vibration. Each first magnetic element 73 transmits the vibration sufficiently to the wall of the corresponding first housing member 71, causing the wall of each first housing member 71 to vibrate synchronously with the corresponding first magnetic element 73. As a result, the air outside each first housing member 71 is vibrated to make sound. Since the device 70 of the present embodiment has a cubic structure composed of six first housing members 71, and the wall of each first housing member 71 can vibrate to generate sound, users in front of and beside each first housing member 71 of the device 70 can hear the sound produced by the device 70 with equal clarity. In other words, the directivity of sound generated by the device 70 is substantially lowered. Furthermore, as the outer configuration of the device 70 is not limited to a cube, the directivity of sound generated by the device 70 can be further lowered by designing the outer configuration of the device 70 as a regular tetrahedron, a regular octahedron, a regular dodecahedron, or other symmetric or asymmetric polyhedrons. In that case, no matter where the users are located in relation to the device 70, the sound generated by the device 70 can be heard with equal ease and clarity, thus broadening the applicability of the device 70 and increasing the industrial value thereof.

Figure 10:
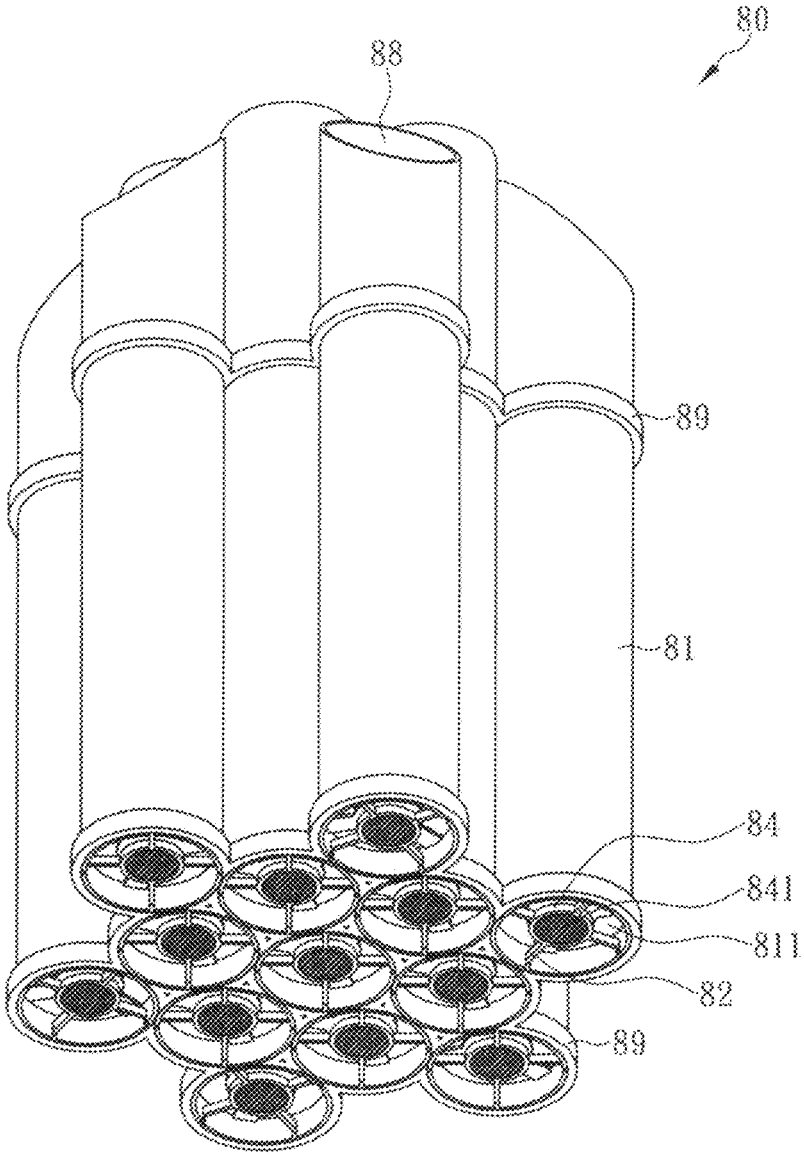
FIG. 10 is a perspective view of a seventh preferred embodiment of the present invention.

FIG. 10 shows a device 80 with a dynamic magnet loudspeaker according to a seventh preferred embodiment of the present invention, wherein the device 80 includes thirteen first housing members 81, each formed as a hollow tube. The first housing members 81 are arranged in a honeycomb configuration and are held together as a single unit by at least one fixing seat 89. In other embodiments of the present invention, however, the number of the first housing members 81 in the device 80 is not limited to thirteen and may vary according to practical needs, and the first housing members 81 may be arranged in any configurations other than the honeycomb configuration disclosed herein.

Referring to FIG. 10, while the first housing members 81 in the seventh preferred embodiment of the present invention are shaped as circular tubes, the configuration of each first housing member 81 is not limited a circular tube but may also be a tube with a rectangular, rhombus-shaped, or other cross-section; a spiral tube; or a tube curved at arbitrary angles. Moreover, the first housing members 81 are made of plastic, fibers, metal (e.g., copper), or other suitable materials. At least one first magnetic element (not shown in the drawing but equivalent to the first magnetic element 23, 33, 43, 53, 63 or 73 in the first to sixth preferred embodiments of the present invention) is fixedly provided on the inner surface of a wall 811 of each first housing member 81 near a first end thereof. Also, a seat 82 is provided at the first end of each first housing member 81, and each seat 82 has a periphery connected to a periphery of the first end of the corresponding first housing member 81. In addition, a hollow tube 84 is fixedly provided in each seat 82 and corresponds in position to the first magnetic element in the corresponding first housing member 81. A first coil unit 841 is fixedly mounted around a first end of each hollow tube 84. The first end of each hollow tube 84 extends toward the corresponding first magnetic element and is mounted around the outer periphery thereof. Each first housing member 81 further has a second end formed with an opening 88 such that the second ends of the first housing members 81 are open. In a different embodiment of the present invention, however, the second end of each first housing member 81 is closed; consequently, each first housing member 81 becomes a tube with two closed ends.

Figure 11:
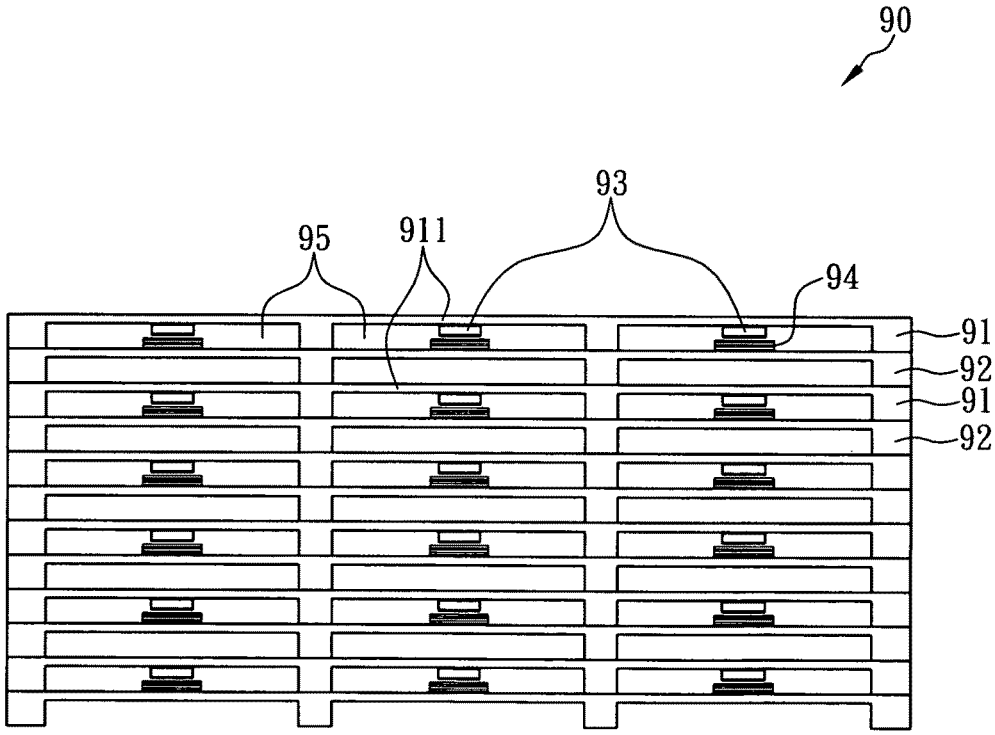
FIG. 11 is a schematic view of an eighth preferred embodiment of the present invention.

Referring to FIG. 11, a device 90 with a dynamic magnet loudspeaker according to an eighth preferred embodiment of the present invention includes six first housing members 91 and six seats 92. The device 90 is formed by stacking the first housing members 91 and the seats 92 in an alternate fashion. In practice, however, the number of the first housing members 91 and of the seats 92 may be modified according to practical needs. The first housing members 91 and the seats 92 have plate-like configurations and are made of plastic, fibers, metal, or other materials that can be formed into plates. At least one first magnetic element 93 is fixedly provided on a surface of a wall 911 of each first housing member 91. At least one hollow tube 94 is fixedly provided in each seat 92 and corresponds in position to the at least one first magnetic element 93. A first coil unit (not shown in the drawing but equivalent to the first coil unit 241, 341, 441, 741, or 841 in the first to seventh preferred embodiments of the present invention) is fixedly mounted around a first end of each hollow tube 94. When the seats 92 and the first housing members 91 are stacked together, at least one receiving space 95 is formed between the surface of the wall 911 of each first housing member 91 and the adjacent seat 92, and the first coil units are mounted around the outer peripheries of the first magnetic elements 93, respectively.

Once the first housing members 91 and the seats 92 are stacked into a single unit, and the first coil units at the first ends of the hollow tubes 94 are magnetized by a current to generate magnetic lines, the magnetic lines generated by the first coil units and the magnetic lines generated by the first magnetic elements 93 cause attraction or repulsion that drives the first magnetic elements 93 to vibrate reciprocally. The first magnetic elements 93 then transmit the vibration sufficiently to the walls 911 of the first housing members 91. In consequence, the walls 911 of the first housing members 91 vibrate synchronously with the first magnetic elements 93 and thereby vibrate the air outside the first housing members 91 to make sound. As the device 90 in the present embodiment is formed by alternately stacking six first housing members 91 and six seats 92, and the wall 911 of each first housing member 91 can vibrate to generate sound, the sound reproduced by the device 90 can be clearly heard from all directions. In other words, the directivity of sound generated by the device 90 is significantly lowered.

Figure 12:
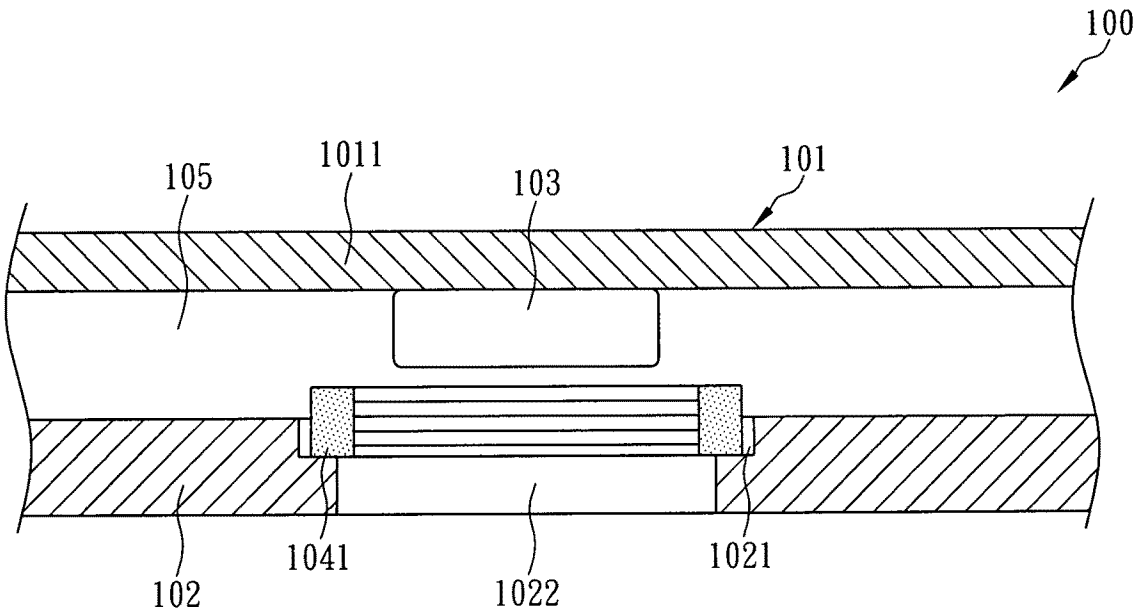
FIG. 12 is a schematic view of a ninth preferred embodiment of the present invention.

Referring to FIG. 12, a device 100 with a dynamic magnet loudspeaker according to a ninth preferred embodiment of the present invention includes a first housing member 101, a seat 102, and a first coil unit 1041. A first magnetic element 103 is fixedly provided on an inner surface of a wall 1011 of the first housing member 101. The seat 102 has a side connected to the first housing member 101 to form a single unit, thereby defining a first receiving space 105 between the first housing member 101 and the side of the seat 102. In addition, a recess 1021 is provided on the seat 102 and corresponds in position to the first magnetic element 103. The recess 1021 is centrally formed with a through hole 1022 that communicates with the first receiving space 105, and the first coil unit 1041 is fixedly provided in the recess 1021. However, while the recess 1021 in the present embodiment is configured for fixing the first coil unit 1041, it is also feasible to provide the seat 102 with a frame for securing the first coil unit 1041, wherein the frame corresponds in position to the first magnetic element 103 and may have various shapes. The first coil unit 1041 is formed by at least one metal wire wound in a predetermined way. The first coil unit 1041 has an end extending toward the first magnetic element 103 such that, when the first coil unit 1041 is magnetized to generate magnetic lines, the magnetic lines generated by the first coil unit 1041 and the magnetic lines generated by the first magnetic element 103 create attraction or repulsion that drives the first magnetic element 103 to vibrate reciprocally along with the first housing member 101, thereby making sound.

In practice, a metal ring or metal plate (not shown, made of aluminum or other metal materials) may be fixedly attached to a second side of the seat 102 as appropriate, such that the aluminum ring or aluminum plate corresponds in position to and partially or completely covers the through hole 1022. The aluminum ring or aluminum plate can transmit the heat generated by the first coil unit 1041 and the seat 102 to the second side of the seat 102 to enhance heat dissipation from the device 100.

The terminology used herein and the foregoing description of the embodiments (e.g., the cross-sectional configuration, assembly mode, number, and material of the housing members; the outer configuration of the device; the number, shapes, provision (or not), and location of the magnetic elements and the hollow tubes; etc.) are intended only to demonstrate the preferred embodiments of the present invention and should not be construed in a limiting sense. Therefore, all variations and structural modifications based on the technical contents disclosed herein and easily conceivable by a person skilled in the art, as well as all equivalent changes implemented by other structures or devices, should fall within the scope of the present invention.

What is claimed is:

1. A device with a dynamic magnet loudspeaker, the device comprising:

a first housing member having a wall, wherein a first magnetic element is fixedly provided on an inner surface of the wall;

a seat having a first side connected to the first housing member to form a single unit and thereby define a first receiving space between the first housing member and the first side of the seat;

a first coil unit fixedly provided on the seat and corresponding in position to the first magnetic element, wherein the first coil unit is formed by at least a metal wire wound in a predetermined way and has an end extending toward the first magnetic element such that, when the first coil unit is magnetized to generate magnetic lines, the magnetic lines generated by the first coil unit and magnetic lines generated by the first magnetic element create attraction or repulsion that drives the first magnetic element as well as the first housing member to vibrate reciprocally and thereby make sound;

a hollow tube fixedly provided on the seat and corresponding in position to the first magnetic element, wherein the first coil unit is fixedly mounted around a first end of the hollow tube, and the hollow tube penetrates the seat such that a second end of the hollow tube juts out of a second side of the seat;

a second housing member connected to the seat to form a single unit and thereby define a second receiving space between the second housing member and the second side of the seat; and a second magnetic element fixedly provided on an inner surface of a wall of the second housing member and corresponding in position to the second end of the hollow tube, wherein a second coil unit fixedly mounted around the second end of the hollow tube is formed by at least a metal wire wound around the second end of the hollow tube in a predetermined way, and the second end of the hollow tube extends toward the second magnetic element and is either mounted around an outer periphery of the second magnetic element or inserted in a second central hole of the second magnetic element.

2. The device of claim 1, wherein a plurality of ribs are provided on the inner surface of the wall of the first housing member and extend radially outward from a vicinity of the first magnetic element, and a plurality of ribs are provided on the inner surface of the wall of the second housing member and extend radially outward from a vicinity of the second magnetic element.

3. The device of claim 1, wherein an annular magnetic element is provided on the inner surface of the wall of each of the first and the second housing members, each said annular magnetic element is mounted around and located outside a corresponding one of the first and second magnetic elements, and each said annular magnetic element has an annular central hole for receiving a corresponding one of the first and second magnetic elements such that a predetermined spacing is formed between an inner periphery of each said annular magnetic element and a corresponding one of an outer periphery of the first magnetic element and the outer periphery of the second magnetic element.

4. The device of claim 1, wherein the inner surface of the wall of each of the first and second housing members extends toward the hollow tube such that an outer surface of the wall of each of the first and second housing members is sunken toward the hollow tube to form a conical recess.

5. The device of claim 4, wherein the outer surface of the wall of the first housing member has a peripheral portion facing away from the first magnetic element and fixedly provided with a third housing member such that a resonant space is formed between an inner surface of the third housing member and the outer surface of the wall of the first housing member, and the outer surface of the wall of the second housing member has a peripheral portion facing away from the second magnetic element and fixedly provided with a fourth housing member such that a resonant space is formed between an inner surface of the fourth housing member and the outer surface of the wall of the second housing member.

6. A device with a dynamic magnet loudspeaker, the device comprising:

a first housing member having a wall, wherein a first magnetic element is fixedly provided on an inner surface of the wall, and a plurality of ribs are provided on the inner surface of the wall of the first housing member and extend radially outward from a vicinity of the first magnetic element;

a seat having a first side connected to the first housing member to form a single unit and thereby define a first receiving space between the first housing member and the first side of the seat;

a first coil unit fixedly provided on the seat and corresponding in position to the first magnetic element, wherein the first coil unit is formed by at least a metal wire wound in a predetermined way and has an end extending toward the first magnetic element such that, when the first coil unit is magnetized to generate magnetic lines, the magnetic lines generated by the first coil unit and magnetic lines generated by the first magnetic element create attraction or repulsion that drives the first magnetic element as well as the first housing member to vibrate reciprocally and thereby make sound; and a hollow tube fixedly provided on the seat and corresponding in position to the first magnetic element, wherein the first coil unit is fixedly mounted around a first end of the hollow tube.

7. The device of claim 6, wherein the hollow tube has a second end connected to a surface of the first side of the seat.

8. The device of claim 7, further comprising a second housing member connected to a second side of the seat to form a single unit and thereby define a second receiving space between the second housing member and the second side of the seat.

9. The device of claim 8, wherein an inner surface of a wall of the second housing member extends toward the hollow tube such that an outer surface of the wall of the second housing member is sunken toward the hollow tube to form a conical recess.

10. The device of claim 6, wherein an annular magnetic element is provided on the inner surface of the wall of the first housing member, the annular magnetic element is mounted around and located outside the first magnetic element, and the annular magnetic element has an annular central hole for receiving the first magnetic element such that a predetermined spacing is formed between an outer periphery of the first magnetic element and an inner periphery of the annular magnetic element.

11. The device of claim 6, wherein the inner surface of the wall of the first housing member extends toward the hollow tube such that an outer surface of the wall is sunken toward the hollow tube to form a conical recess.

12. The device of claim 6, wherein the outer surface of the wall of the first housing member has a peripheral portion facing away from the first magnetic element and fixedly provided with a third housing member such that a resonant space is formed between an inner surface of the third housing member and the outer surface of the wall of the first housing member.

13. A device with a dynamic magnet loudspeaker, the device comprising:

a first housing member having a wall, wherein a first magnetic element is fixedly provided on an inner surface of the wall, an annular magnetic element is provided on the inner surface of the wall of the first housing member and is mounted around and located outside the first magnetic element, and the annular magnetic element has an annular central hole for receiving the first magnetic element such that a predetermined spacing is formed between an outer periphery of the first magnetic element and an inner periphery of the annular magnetic element;

a seat having a first side connected to the first housing member to form a single unit and thereby define a first receiving space between the first housing member and the first side of the seat;

a first coil unit fixedly provided on the seat and corresponding in position to the first magnetic element, wherein the first coil unit is formed by at least a metal wire wound in a predetermined way and has an end extending toward the first magnetic element such that, when the first coil unit is magnetized to generate magnetic lines, the magnetic lines generated by the first coil unit and magnetic lines generated by the first magnetic element create attraction or repulsion that drives the first magnetic element as well as the first housing member to vibrate reciprocally and thereby make sound; and a hollow tube fixedly provided on the seat and corresponding in position to the first magnetic element, wherein the first coil unit is fixedly mounted around a first end of the hollow tube.

14. The device of claim 13, wherein the hollow tube has a second end connected to a surface of the first side of the seat.

15. The device of claim 14, further comprising a second housing member connected to a second side of the seat to form a single unit and thereby define a second receiving space between the second housing member and the second side of the seat.

16. The device of claim 13, wherein a plurality of ribs are provided on the inner surface of the wall of the first housing member and extend radially outward from a vicinity of the first magnetic element.

17. The device of claim 13, wherein the inner surface of the wall of the first housing member extends toward the hollow tube such that an outer surface of the wall is sunken toward the hollow tube to form a conical recess.

18. The device of claim 15, wherein an inner surface of a wall of the second housing member extends toward the hollow tube such that an outer surface of the wall of the second housing member is sunken toward the hollow tube to form a conical recess.

19. The device of claim 13, wherein the outer surface of the wall of the first housing member has a peripheral portion facing away from the first magnetic element and fixedly provided with a third housing member such that a resonant space is formed between an inner surface of the third housing member and the outer surface of the wall of the first housing member.

20. A device with a dynamic magnet loudspeaker, the device comprising:

a first housing member having a wall, wherein a first magnetic element is fixedly provided on an inner surface of the wall;

a seat having a first side connected to the first housing member to form a single unit and thereby define a first receiving space between the first housing member and the first side of the seat;

a first coil unit fixedly provided on the seat and corresponding in position to the first magnetic element, wherein the first coil unit is formed by at least a metal wire wound in a predetermined way and has an end extending toward the first magnetic element such that, when the first coil unit is magnetized to generate magnetic lines, the magnetic lines generated by the first coil unit and magnetic lines generated by the first magnetic element create attraction or repulsion that drives the first magnetic element as well as the first housing member to vibrate reciprocally and thereby make sound; and a hollow tube fixedly provided on the seat and corresponding in position to the first magnetic element, wherein the first coil unit is fixedly mounted around a first end of the hollow tube, and the inner surface of the wall of the first housing member extends toward the hollow tube such that an outer surface of the wall is sunken toward the hollow tube to form a conical recess.

21. The device of claim 20, wherein the hollow tube has a second end connected to a surface of the first side of the seat.

22. The device of claim 21, further comprising a second housing member connected to a second side of the seat to form a single unit and thereby define a second receiving space between the second housing member and the second side of the seat.

23. The device of claim 20, wherein a plurality of ribs are provided on an inner surface of a wall of the first housing member and extend radially outward from a vicinity of the first magnetic element.

24. The device of claim 20, wherein an annular magnetic element is provided on the inner surface of the wall of the first housing member and is mounted around and located outside the first magnetic element, and the annular magnetic element has an annular central hole for receiving the first magnetic element such that a predetermined spacing is formed between an outer periphery of the first magnetic element and an inner periphery of the annular magnetic element.

25. The device of claim 22, wherein an inner surface of a wall of the second housing member extends toward the hollow tube such that an outer surface of the wall of the second housing member is sunken toward the hollow tube to form a conical recess.

26. The device of claim 20, wherein the outer surface of the wall of the first housing member has a peripheral portion facing away from the first magnetic element and fixedly provided with a third housing member such that a resonant space is formed between an inner surface of the third housing member and the outer surface of the wall of the first housing member.

* * * * *